US005426834A

United States Patent [19]

Collins et al.

[11] Patent Number: 5,426,834

[45] Date of Patent: Jun. 27, 1995

[54] END RELEASE SEAT BELT BUCKLE

[75] Inventors: Cecil A. Collins, Shelby Township; Tammy M. Butchko, Warren; Kurt W. Schulz, Harper Woods; Gerald F. Durbin, Algonac, all of Mich.

[73] Assignee: AlliedSignal Inc., Morristown, N.J.

[21] Appl. No.: 38,661

[22] Filed: Mar. 26, 1993

[51] Int. Cl.[6] ..... A41F 1/00; A44B 11/25

[52] U.S. Cl. ..... 24/641; 24/653

[58] Field of Search ..... 24/641, 642, 653, 637, 24/715, 685

[56] References Cited

U.S. PATENT DOCUMENTS

| | | | |
|---|---|---|---|
| 3,336,641 | 8/1967 | Hunter | 24/653 |
| 3,505,711 | 4/1970 | Carter | 24/653 |
| 4,181,832 | 1/1980 | Ueda . | |
| 4,205,533 | 6/1980 | Meiller et al. | 24/653 X |
| 4,384,391 | 5/1983 | Lindblad et al. . | |
| 4,391,024 | 7/1983 | Morinaga | 24/637 X |
| 4,404,715 | 9/1983 | Sugimoto . | |
| 4,642,858 | 2/1987 | Ishiguro et al. | 24/642 X |
| 4,703,542 | 11/1987 | Hirata et al. | 24/641 |
| 4,916,780 | 4/1990 | Ballet . | |

FOREIGN PATENT DOCUMENTS

| | | | |
|---|---|---|---|
| 1205410 | 9/1970 | United Kingdom | 24/653 |

*Primary Examiner*—Edward K. Look
*Assistant Examiner*—Hoang Nguyen
*Attorney, Agent, or Firm*—Harness, Dickey & Pierce

[57] ABSTRACT

An end release type belt buckle for releasably latching a tongue plate of a safety belt system in a latched position. The belt buckle has a base, a release mechanism and an actuator supported for movement on the base. The base has a stationary latch portion adapted to releasably lock the tongue plate in the latched position. The actuator includes a first surface for urging the tongue plate into the latched position, a second surface for retaining the tongue plate in the latched position, and a third surface for actuating the release mechanism to urge the tongue plate from the latched position into a released position.

16 Claims, 6 Drawing Sheets

END RELEASE SEAT BELT BUCKLE

BACKGROUND OF THE INVENTION

The present invention relates generally to vehicular seat belt restraint systems and, more particularly, to an end release type seat belt buckle.

Modernly, virtually all motor vehicles are equipped with some type of passenger restraint system for physically restraining the seat occupant when the vehicle is subjected to high rates of deceleration which may occur, for example, during heavy braking or a collision. As is known, the most common passenger restraint system is a seat belt system having at least one of a lap belt and a shoulder belt, or a combination thereof, that can be withdrawn from a retractor device for releasably latching a tongue plate to an anchored belt buckle.

Conventional belt buckles may be generally classified in two distinct categories, namely, "central release" type buckles and "end release" type buckles. As is known, central release belt buckles have a centrally located push button that must be depressed in opposition to a spring-biased latch mechanism for releasing the tongue plate from latched engagement therewith. Alternatively, end release type belt buckles are commonly provided with a spring-biased release button that must be longitudinally displaced for pivoting a locking pawl from a locked position to a release position for releasing the tongue plate. While end release buckles are considered to provide enhanced convenience, they are generally complex mechanisms which are often relatively thick and bulky and are difficult and costly to manufacture and assemble.

In view of the foregoing, the need exists to provide an end release belt buckle having a substantially simplified structure, which is reliable in operation, and yet can be easily manufactured and assembled.

SUMMARY OF THE INVENTION

Accordingly, the present invention is directed to an improved end release type belt buckle that is operable for releasably latching a tongue plate of a safety belt restraint system. The end release belt buckle of the present invention includes a base having a stationary latch portion which is adapted to lockingly engage the tongue plate for establishing a locked condition, thereby resisting release of tongue plate from the belt buckle. The belt buckle further includes release means for releasing the tongue plate from the locked condition, and a spring-biased actuator supported for longitudinal movement on the base and which includes means for selectively actuating the release means.

As a related object, the spring-biased actuator further includes means for urging the tongue plate into locked engagement with the latch portion upon insertion of the tongue plate into the belt buckle, and means for retaining tongue plate in the locked condition.

These and other various advantages and features of the present invention will become apparent from the following written description when taken in conjunction with the drawings and appended claims.

DETAILED DESCRIPTION OF THE PREFERRED EMBODIMENT

Figure 1:
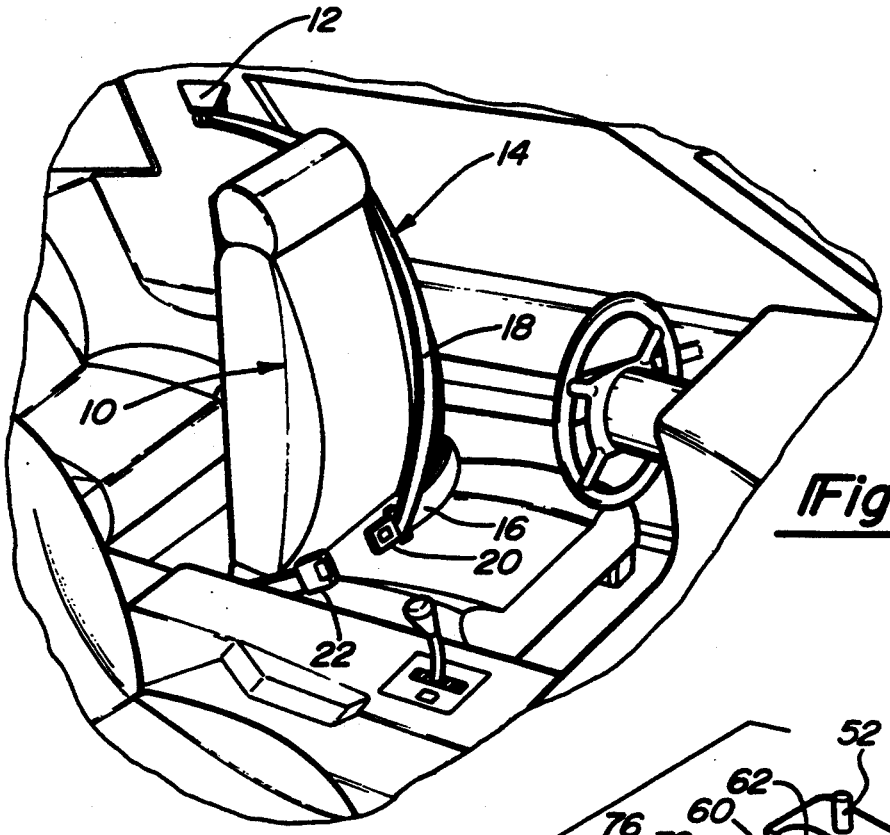
FIG. 1 is a partial interior view of a motor vehicle showing the improved end release belt buckle of the present invention operably associated with an exemplary safety belt restraint system.

With reference to FIG. 1, a portion of the interior of an exemplary motor vehicle is shown to include a seat 10 and a safety belt restraint system having a retractor assembly 12 mounted on a vertical pillar of the motor vehicle in a conventional manner. A safety or "seat" belt 14 includes a lap belt 16 and a shoulder belt 18 which is shown projecting from retractor assembly 12 so as to extend over the shoulder and across the chest of a seat occupant. A tongue plate 20 is retained on shoulder belt 18 and lap belt 16 for fastening to a buckle member 22. Once fastened, seat belt 14 physically restrains the seat occupant within seat 10. In accordance with a preferred embodiment of the present invention, buckle member 22 is an "end release" type belt buckle assembly which incorporates various novel features and structure to be described hereinafter with greater specificity.

Figure 2:
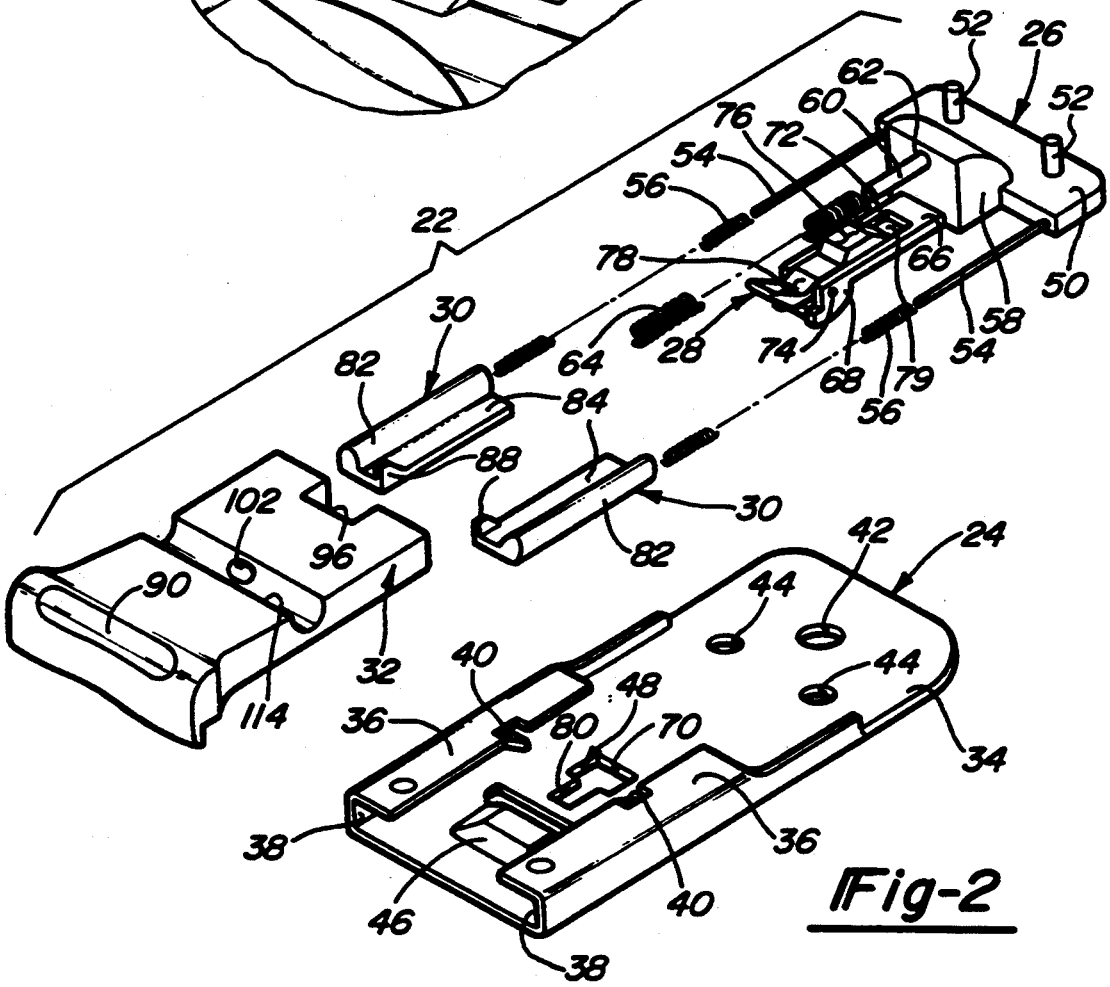
FIG. 2 is an exploded perspective view of the end release belt buckle according to a preferred embodiment of the present invention.
Figure 3:
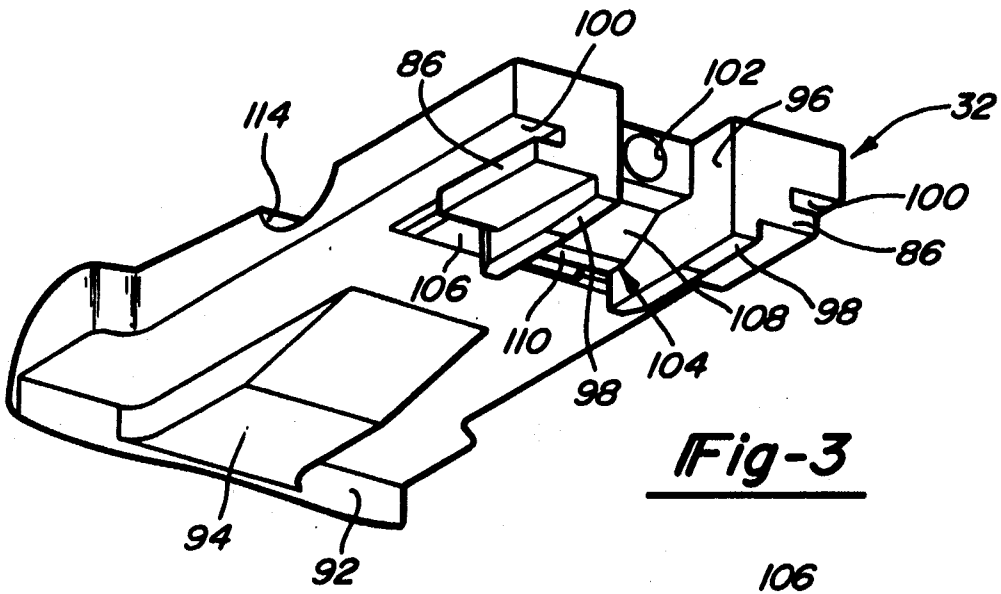
FIG. 3 is a bottom perspective view of the movable actuator member shown in FIG. 1.

With particular reference to FIGS. 2 and 3 of the drawings, the various components associated with end release type belt buckle 22 are shown. However, for purposes of clarity, a protective housing assembly 23 (FIG. 4) which encloses the components has been deleted. In general, belt buckle 22 is an assembly of various components and sub-assemblies which include a base 24, a support block 26 adapted for direct mounting on base 24, and a rocker arm 28 supported for pivotable movement on support block 26. In addition, belt buckle 22 also includes a pair of spring-biased ejector arms 30 and a spring-biased actuator member 32.

Figure 4:
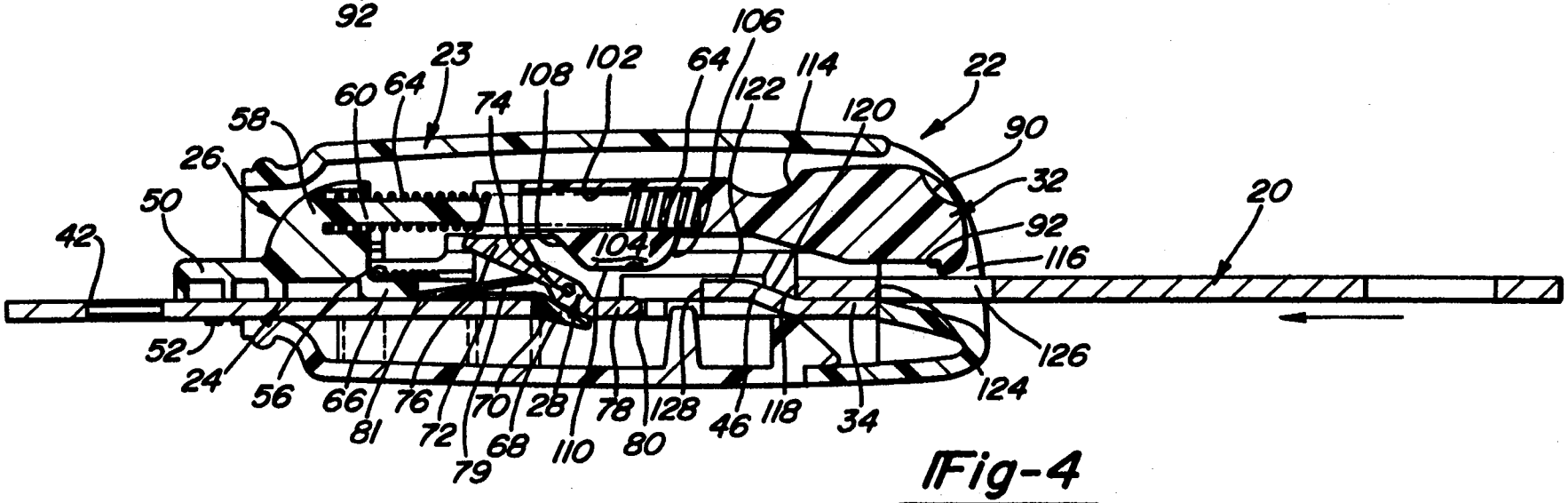
FIGS. 4 through 11 are cross-sectional views of the belt buckle showing a sequence of operations for latching and subsequently releasing a tongue plate.

From the construction shown, base 24 is a rigid structural component formed to include a plate segment 34 and a pair of orthogonal flange segments 36 which extend inwardly along opposite lateral sides of plate segment 34. As such, each flange segment 36 defines an elongated longitudinal guide channel 38 and has a downwardly extending stop projection 40 formed thereon. Plate segment 34 is also formed to include an anchor mounting aperture 42, a pair of support block mounting apertures 44, a raised latch portion 46 and a generally T-shaped access aperture 48. Support block 26 is shown to include a lateral support segment 50 having locating pins 52 formed on its underside surface which are adapted to be inserted (i.e., "snapped") into mounting apertures 44 for fixedly securing support block 26 on plate segment 34 of base 24 (as shown in FIG. 4). In addition, a pair of laterally-spaced spring posts 54 extend forwardly from a front face of lateral support segment 50 for retaining and supporting a first end of elongated ejector springs 56 thereon. Support block 26 also includes a raised backstop segment 58 having a spring post 60 projecting out of a counterbore 62 and on which a first end of an elongated return spring 64 is retained. Furthermore, an extension segment 66 projects from backstop segment 58 and terminates in a downwardly stepped lug 68 which is adapted to be retained within a rear cut-out portion 70 of T-shaped access aperture 48. Extension segment 66 has a shallow channel 72 formed therein with rocker arm 28 mounted on a pivot pin 74 at the distal end of channel 72 for pivotable movement with respect thereto. More particularly, a rear lever portion 76 of rocker arm 28 is retained within channel 72 while a forward lifter portion 78 of rocker arm 28 extends from lug 68 and is adapted to be disposed for pivotable movement within a front portion 80 of T-shaped access aperture 48. To provide means for normally biasing forward lifter portion 78 of rocker arm 28 to extend into front portion 80 of T-shaped access aperture 48, a cantilevered beam 79 extends from backstop segment 58 within shallow channel 72 of extension segment 66 and has a distal end that is adapted to act on an underside surface of rear lever portion 76. In addition, a transverse flange or rib 81 (FIG. 4) is integrally formed on the underside surface of beam 79 in close proximity to backstop segment 58. Upon installation of support block 26 onto base 24, rib 81 engages plate segment 34 for forcibly urging the distal end of beam 79 in an upward direction displaced from channel 72 and in engagement with lever portion 76 of rocker arm 28. Such a biasing arrangement is desirable in that it inhibits the propagation of noise (i.e., "rattling") of rocker arm 28 within belt buckle 22. Thus, installation of locating pins 52 into mounting apertures 44 and retention of stepped lug 68 within cut-out portion 70 of access aperture 48 is operable for positively locating rocker arm 28 relative to base 24.

With continued reference to FIGS. 2 and 3, ejector arms 30 are shown to be substantially mirror-image components each having a raised lug segment 82 adapted for sliding translational movement within its respective guide channel 38. Each ejector arm 30 also has a lower planar segment 84 which provides a sliding bearing surface upon which outwardly extending wings 86, formed on opposite lateral sides of actuator member 32, are supported for sliding movement. In addition, an upwardly extending fin 88 is formed on the inner forward edge of each planar segment 84. Furthermore, an elongated bore (not shown) is formed in the rearward portion of each raised lug segment 82 which is adapted to retain the opposite end of its respective ejector spring 56 therein. Thus, ejector arms 30 are normally biased by ejector spring 56 away from support block 26.

Actuator member 32 is a manually-operable button release which is shown to include a pressure surface, such as a finger pad 90, a downwardly extending front edge stop 92 and a central reinforcing rib 94 formed on its underside surface. The rear portion of actuator member 32 defines a recessed segment 96 having its lateral edges defined by downwardly extending rails 98. Rails 98 are adapted to engage plate segment 34 for supporting actuator member 32 for sliding movement relative to base 24. In addition, wings 86 extend outwardly from rails 98 and define guide slots 1 00 within which the inwardly bent portions of orthogonal flange segments 36 on base 24 are retained. Thus, actuator member 32 is supported for sliding movement relative to base 24 in a manner that is independent of sliding movement of ejector arms 30. In addition, a bore 102 is formed centrally within recessed segment 96 of actuator member 32 and is adapted to support and retain the opposite end of return spring 64 therein. Thus, actuator member 32 is also normally biased in a direction away from support block 26. Finally, a retainer block 104 is integrally formed on the underside of actuator member 32 between rails 98 and includes a front cam surface 106, a rear cam surface 108 and an intermediate surface 110 formed therebetween. As will be detailed, the profile of retainer block 104 is such that front cam surface 106 is adapted to assist in latching tongue plate 20 within belt buckle 22, intermediate surface 110 is adapted to retain tongue plate 20 in a latched condition, and rear cam surface 108 is adapted to act on rear lever portion 76 of rocker arm 28 for releasing tongue plate. The above-noted operative features associated with retainer block 104 are all predicated on the position of actuator member 32 with respect to latch portion 46.

To assemble end release belt buckle 22, ejector arms 30 are slid into their respective guide channels 38 of base 24. Ejector arms 30 are prevented from sliding out of the front of guide channels 38 by bumper stops 112 which are aligned to engage a front face of raised lug segments 82. Thereafter, actuator member 32 is assembled onto base 24 by placing the front edges of wing members 86 below the rear edges of flange segments 36 with front edge stop 92 resting on the upper surface of flange segment 36, and then sliding actuator member 32 forward until front edge stop 92 can be snapped down in front of the front edge of base 24. To assist in such assembly, a lateral channel 114 is formed in the upper surface of actuator member 32 for allowing actuator member 32 to resiliently flex, thereby allowing each wing member 86 to slide within its guide channel 38 above planar segment 84 of ejector arm 30 while front edge stop 92 slides along the top surface of flange segments 36. Once assembled, actuator member 32 is allowed to slide on base 24 between a forward limit position defined by the leading edges of wing members 86 engaging stop projections 40, and a rearward limit position defined by front edge stop 92 engaging the front edge of base 24. In addition, ejector arms 30 are thereafter prevented from sliding out of the rear end of guide channels 38 due to fins 88 abutting wings 86 on actuator member 32.

Further assembly is accomplished by pivotally mounting rocker arm 28 to extension segment 66 of support block 26. One end of each ejector spring 56 is then placed over one of spring posts 54, while one end of return spring 64 is placed over central spring post 60 and slid into counterbore 62. The resulting support block subassembly is then mounted on base 24 by placing the rear face surface of stepped lug 68 against the rear edge of cut-out portion 70 of T-shaped access opening 48 and inserting locating pins 52 into support block mounting apertures 44. Upon such assembly, the front end of each ejector spring 56 is disposed with the bore formed in raised lug 82 of its respective ejector arm 30 while the front end of return spring 64 is retained within bore 102 in actuator member 32, whereby actuator member 32 and ejector arms 30 are forcibly urged to their forward limit positions. As noted, such assembly also causes cantilevered beam 79 to be forcibly urged upwardly into contact with the underside surface of rear lever portion 76 for biasing rocker arm 28 relative to access opening 48. Thereafter, housing assembly 23, shown to include otherwise conventional upper and lower housing sections, is secured in a known manner to surround the above-noted components. Finally, belt buckle 22 is anchored to the vehicle structure by a fastener (not shown) which is disposed within anchor mounting aperture 42.

Figure 5:
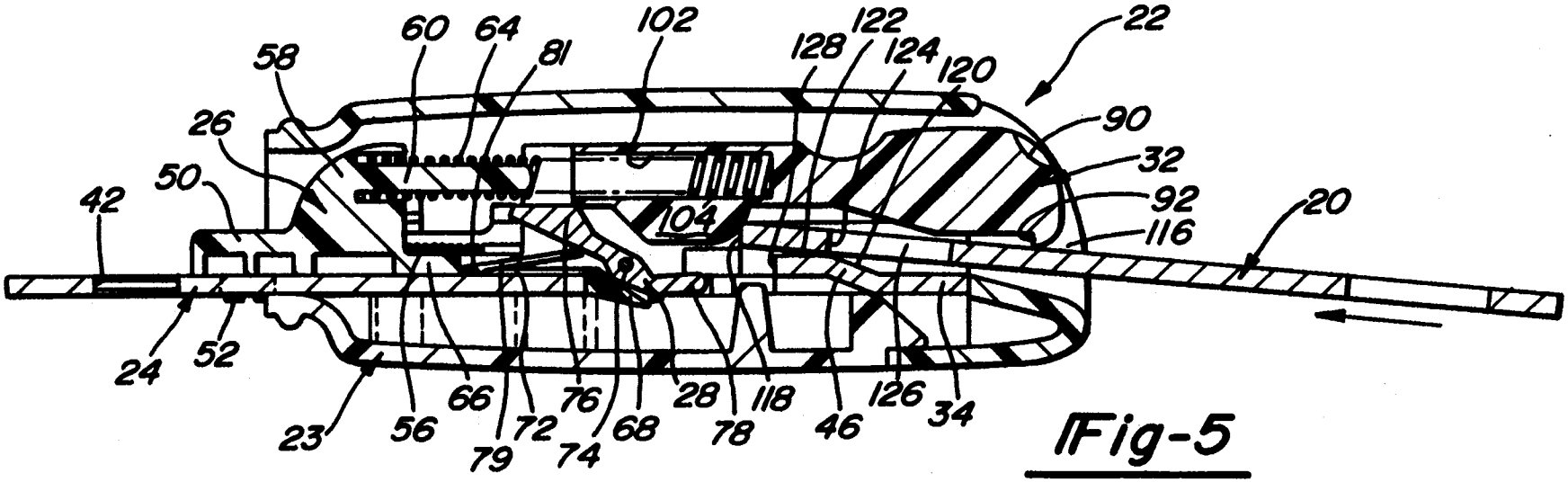
Figure 6:
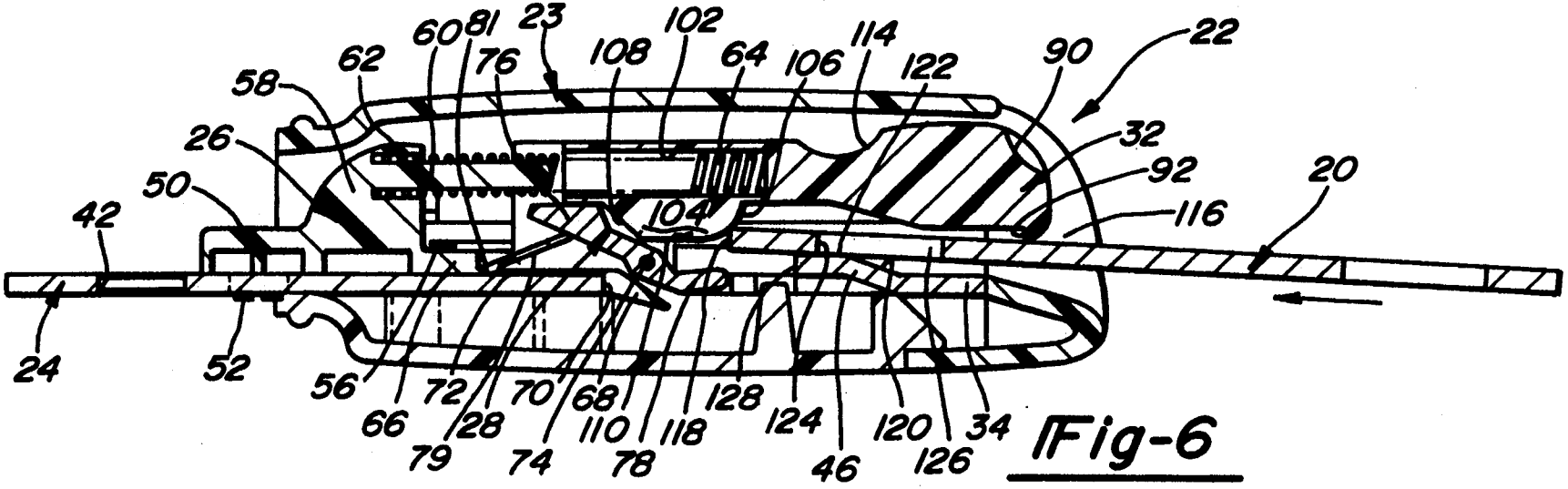

With particular reference now to FIGS. 4 through 11, the process by which belt buckle 22 is releasably latched to tongue plate 20 is sequentially depicted. As shown in FIG. 4, tongue plate 20 is inserted within an entry slot 116 defined vertically by front edge stop 92 of actuator member 32 and plate segment 34 of base 24, and defined laterally by flange segments 36 (FIG. 2) of base 24. As a leading edge 118 of tongue plate 20 is inserted into slot 116, it initially contacts ejector arms 30 for forcibly urging ejector arms 30 rearwardly in opposition to the biasing of ejector springs 56. Latch portion 46 is integral with plate segment 34 and defines a upwardly extending ramp surface 120 which tends to force tongue plate 20 to be slightly angularly displaced during insertion into entry slot 116, as depicted in FIG. 5. Upon continued insertion, leading edge 118 rides over a planar end surface 122 of latch portion 46 and eventually contacts first cam surface 106 of retainer block 104 for forcibly urging actuator member 32 to move rearwardly in opposition to the biasing force exerted thereon by return spring 64. As seen from FIGS. 6 and 7, continued engagement of leading edge 118 with first cam surface 106 causes continued rearward movement of actuator member 32 until leading edge 118 eventually contacts lifter portion 78 of rocker arm 28, thereby forcibly pivoting rocker arm 28 in a first direction (i.e., clockwise in the drawings) about pivot 74. Alternatively, the biasing of rocker arm 28 due to engagement of cantilevered beam 79 with plate segment 34 of base 24 may be sufficient to permit leading edge 118 to slide over lifter portion 78 of rocker arm 28.

Figure 7:
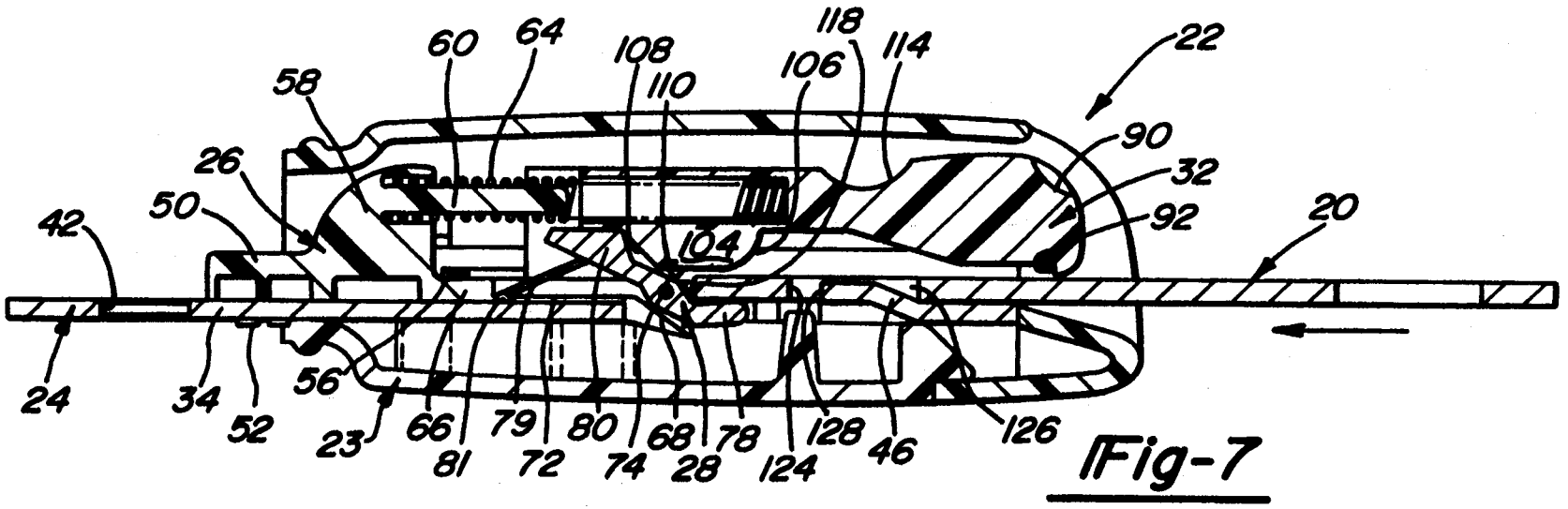

With reference to FIG. 7, as a front edge 124 of a latch aperture 126 formed in tongue plate 20 crosses the threshold defined by a rear locking edge 128 of latch portion 46, leading edge 118 of tongue plate 20 slides off first cam surface 106 of actuator member 32 such that latch aperture 126 is urged downwardly for surrounding latch portion 46, thereby establishing a "latched" position. Such action is due to the cam profile of first cam surface 106 and the biasing exerted thereon by return spring 64. As can be seen, once leading edge 118 disengages first cam surface 106, return spring 64 immediately biases actuator member 32 forwardly such that intermediate surface 110 covers leading edge 118. If the seat occupant attempts to continue to insert tongue plate 20 into buckle entry slot 116 beyond the "latched" position, tongue plate 20 reaches an "override" position (FIG. 7) at which point continued insertion is inhibited due to leading edge 118 engaging one of rocker arm 28 or lug 68.

After the insertion force imposed by the seat occupant on tongue plate 20 is released, return spring 64 urges actuator member 32 to move forwardly to its forward limit position such that intermediate surface 110 of retainer block 104 is still positioned over leading edge 118 of tongue plate 20. Concurrently, ejector springs 56 urge ejector arms 30, as well as tongue plate 20, to move forwardly until front edge 124 of latch aperture 126 on tongue plate 20 contacts and lockingly engages locking edge 128 of latch portion 46 in a "spring-biased" latched position, shown in FIG. 8. As can be seen, retainer block 104 is operable for retaining tongue plate 20 in the spring-biased latched position shown.

Figure 8:
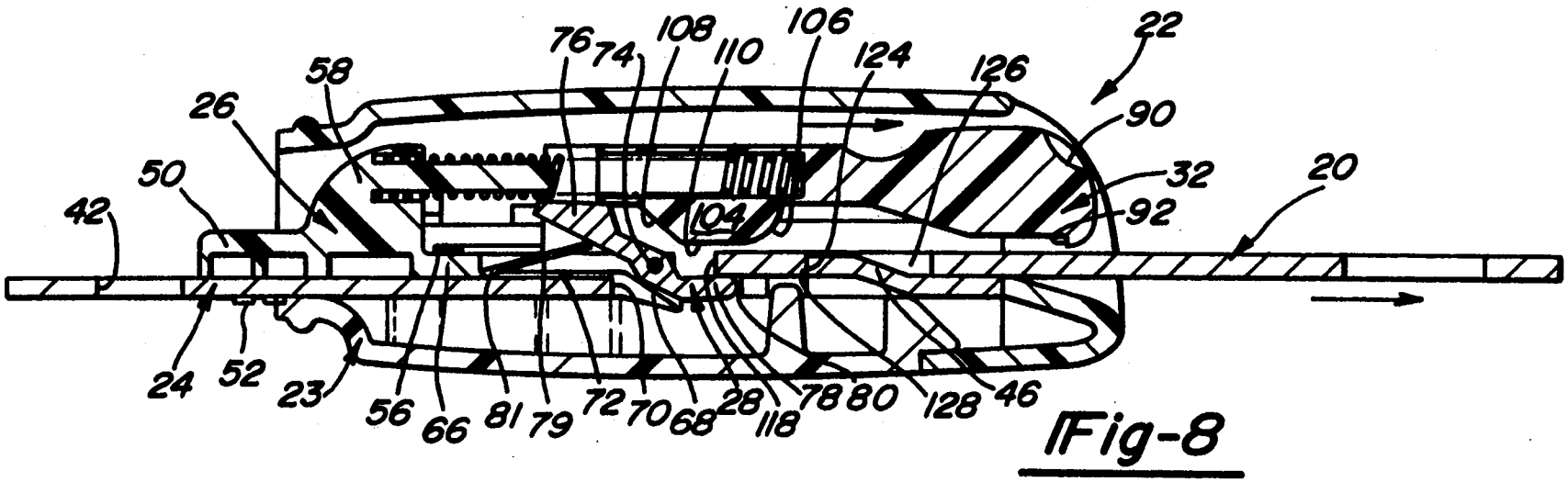
Figure 9:
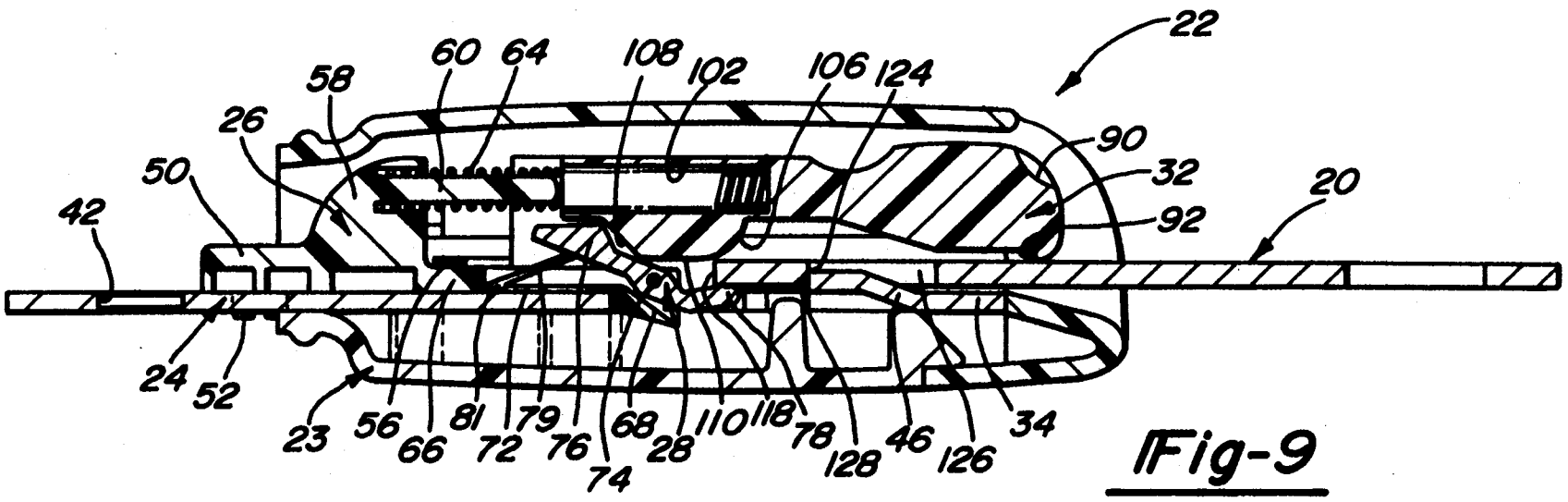
Figure 10:
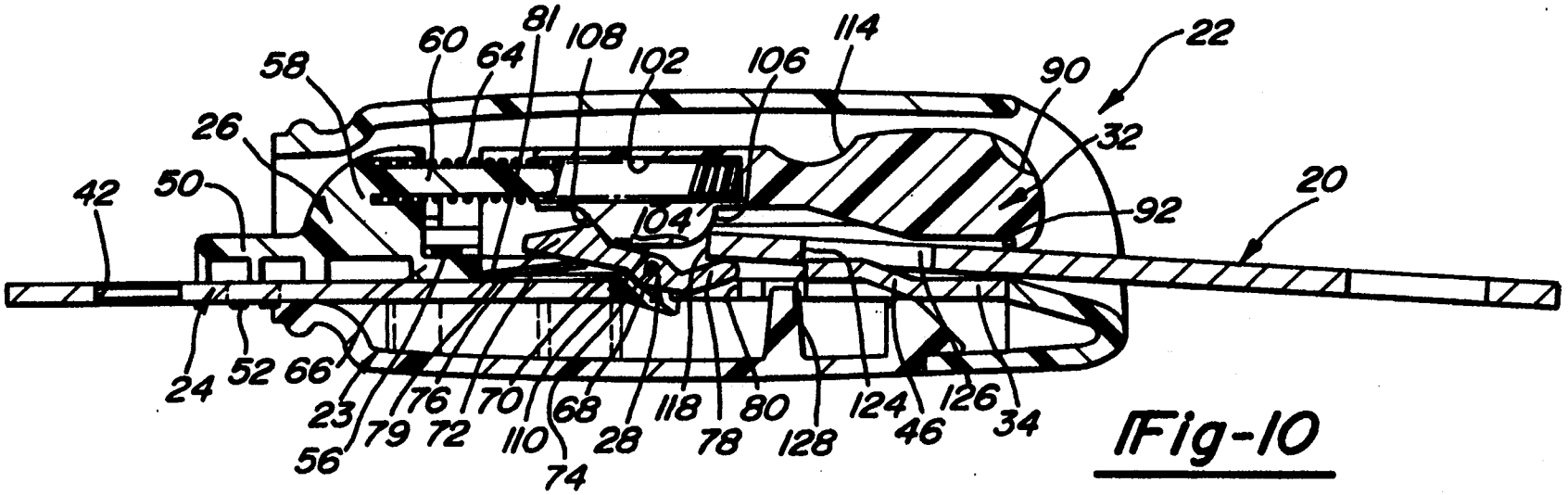
Figure 11:
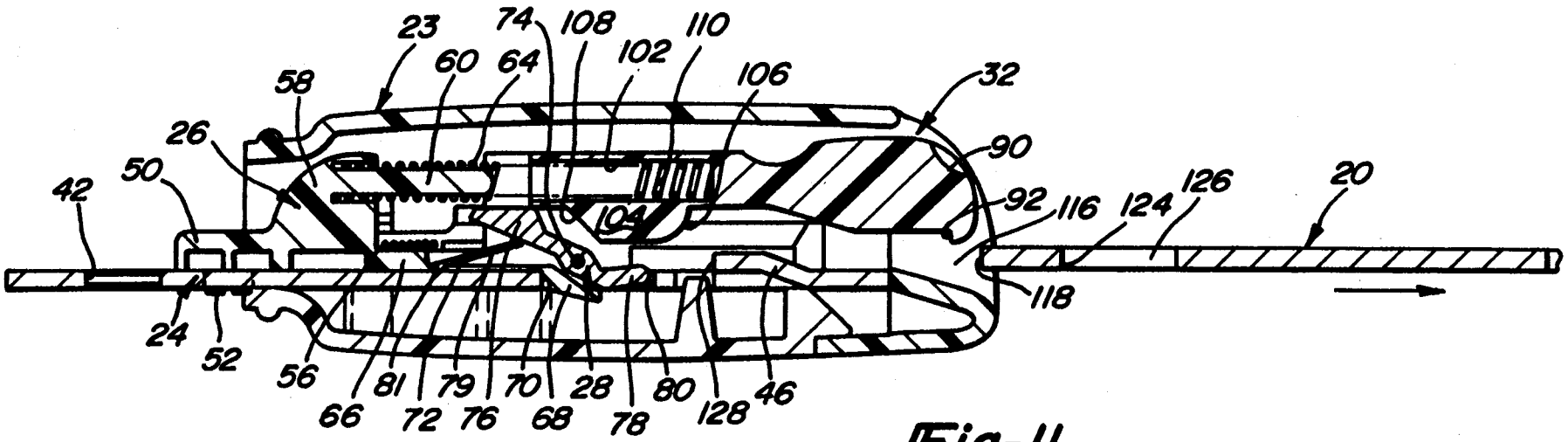

To release tongue plate 20 from end release belt buckle 22, the seat occupant must forcibly slide actuator member 32 inwardly in opposition to the biasing of return spring 64 from the "spring-biased" latched position of FIG. 8 progressively through the intermediate position of FIG. 9 to the "released" position of FIG. 10. As seen from FIG. 9, initial movement of actuator member 32 toward the released position causes intermediate surface 110 of retainer block 104 to uncover leading edge 118 of tongue plate 20 and expose it to first cam surface 106. Upon continued inward movement of actuator member 32, second cam surface 108 of retainer block 104 engages lever portion 76 of rocker arm 28 for causing rocker arm 28 to pivot about pivot 74 in a second direction (i.e., counterclockwise in drawings). Such pivotable movement of rocker arm 28 causes lifter portion 78 to forcibly act on the underside surface of tongue plate 20 in close proximity to leading edge 118. As seen from FIG. 10, such action causes leading edge 118 to ride up or cam on first cam surface 106, whereby front edge 124 of latch aperture 126 is released from engagement with locking edge 128 of latch portion 46 for establishing the "released" position. Once tongue plate 20 is angularly displaced to the released position, ejector arms 30 under the biasing influence of ejector springs 56, forcibly urge tongue plate 20 out of entry slot 116, thus assisting in ejection of tongue plate 20 from belt buckle 22. The length of lever portion 76 can be selected for establishing a desired release force exerted on actuator member 32 to release tongue plate 20 when seat belt 14 is under load. Finally, tongue plate 20 is shown in FIG. 11 in a completely ejected or withdrawn position following release of actuator member 32 by the seat occupant. As will be appreciated, upon such complete withdrawal of tongue plate 20, ejector arms 30 and actuator member 32 are biased to return to their forward limit positions (FIGS. 4 and 11).

The present invention thus provides an improved "end release" belt buckle 22 which is relatively simple in structure and easily manufactured and assembled. Moreover, belt buckle 22 of the present invention provides a fixed latch portion 46 which may be integrally formed with base 24, rather than use of a conventional movable locking pawl which is inherently less reliable. Moreover, the present invention provides a single arrangement for forcibly urging tongue plate 20 into a latched position, retaining tongue plate 20 in the latched position, and actuating a release mechanism for urging the tongue plate out of the latched position when release of tongue plate 20 is desired.

It should be understood that an unlimited number of configurations of the present invention can be realized. The foregoing discussion discloses and describes a merely exemplary embodiment of the present invention. One skilled in the art will readily recognize from the discussion and from the accompanying drawings and claims that various changes and modifications can be made without departing from the spirit and scope of the invention, as defined in the following claims.

What is claimed is:

1. A buckle for releasably latching a tongue plate, comprising:

a base having a stationary latch portion adapted for releasably locking the tongue plate in a latched position and inhibiting removal of the tongue plate from said buckle when the tongue plate is in said latched position;

a release mechanism for causing movement of the tongue plate from said latched position to a released position; and an actuator supported for movement on said base and having first cam means for urging the tongue plate into said latched position in response to insertion of the tongue plate into said buckle, second cam means for actuating said release mechanism to move the tongue plate to said released position, and retaining means for retaining the tongue plate in said latched position.

2. The buckle as set forth in claim 1 wherein said actuator is adapted for selective movement between a first position wherein said retaining means retains the tongue plate in said latched position, and a second position wherein said retaining means allows the tongue plate to move from said latched position to said released position.

3. The buckle as set forth in claim 2 wherein said release mechanism acts on the tongue plate for urging the tongue plate to move from said latched position to said released position in response to movement of said retaining means to said second position.

4. The buckle as set forth in claim 3 wherein said second cam means actuates said release mechanism to forcibly move the tongue plate from said latched position to said released position when said actuator is moved from said first position to said second position.

5. The buckle as set forth in claim 4 wherein said release mechamism is a rocker that is mounted for pivotable movement to said base.

6. The buckle as set forth in claim 5 wherein said second cam means engages a lever portion of said rocker when said actuator is moved from said first position to said second position for pivoting said rocker such that a lifter portion of said rocker engages the tongue plate for moving the tongue plate from said latched position to said released position.

7. The buckle as set forth in claim 6 further comprising biasing means for normally biasing said actuator toward said first position.

8. The buckle as set forth in claim 3 further comprising ejector means for urging the tongue plate from said buckle when the tongue plate is in said released position.

9. The buckle as set forth in claim 1 further comprising override means for resisting insertion of the tongue plate into said buckle more than a predetermined distance beyond said latched position.

10. A buckle for releasably latching a tongue plate, comprising:

a base having a stationary latch portion adapted for releasably locking the tongue plate in a latched position in response to insertion of the tongue plate into said buckle;

a release mechanism for urging the tongue plate to move from said latched position to a released position;

an actuator supported for movement on said base and having a first surface engageable with the tongue plate upon insertion into said buckle for urging the tongue plate into said latched position, and a second surface for selectively actuating said release mechanism to move the tongue plate to said released position.

11. The buckle as set forth in claim 10 wherein said actuator is supported for selective movement on said base between a first position wherein a third surface of said actuator covers a portion of the tongue plate, and a second position wherein said third surface uncovers the tongue plate and said second surface actuates said release mechanism for moving the tongue plate to said released position.

12. The buckle as set forth in claim 11 wherein said release mechanism is a rocker arm supported for pivotable movement on said base, and wherein said second surface engages a first portion of said rocker arm in response to movement of said actuator to said second position for causing a second portion of said rocker arm to pivot into engagement with the tongue plate for moving it to said released position.

13. A buckle for releasably latching a tongue plate, comprising:

a base having a latch portion for releasably locking the tongue plate in a latched position;

an actuator supported on said base for movement between a first position retaining the tongue plate in said latched position and a second position for causing the tongue plate to move to a released position relative to said latch portion;

first biasing means for normally biasing said actuator toward said first position; and a release mechanism for causing movement of the tongue plate to said released position in response to movement of said actuator to said second position, said release mechanism including a rocker arm supported for pivotable movement and second biasing means for normally urging said rocker arm to pivot in a first direction;

whereby upon insertion of the tongue plate into said buckle a leading edge thereof engages a first cam surface on said actuator for forcibly urging said actuator to move from said first position to an intermediate position between said first and second positions whereat the tongue plate is moved into its latched position, and wherein said first biasing means moves said actuator to its first position following movement of the tongue plate to its latched position, and wherein selective movement of said actuator to said second position causes a second cam surface on said actuator to contact said rocker arm and cause pivotable movement thereof in a second direction such that said rocker arm engages the tongue plate and moves it to its released position.

14. The buckle of claim 13 further comprising a pair of spring-biased ejector arms supported on said base for sliding movement independent of movement of said actuator, said ejector arms acting on the tongue plate such that upon the tongue plate being moved to its released position said ejector arms forcibly urge the tongue plate out of said buckle.

15. The buckle of claim 13 wherein said latch portion defines an upwardly extending ramp surface which forces the tongue plate to be angularly displaced upon insertion into said buckle and into contact with said first cam surface on said actuator.

16. The buckle of claim 13 wherein said actuator includes an intermediate surface between said first and second cam surfaces with said intermediate surface aligned to overlay the leading edge of the tongue plate in its latched position to assist in retaining the tongue plate in said latched position.

* * * * *